US006367538B1

(12) United States Patent
Ghosh et al.

(10) Patent No.: US 6,367,538 B1
(45) Date of Patent: Apr. 9, 2002

(54) MOLD AND MOLD BASKET FOR USE IN UNI-DIRECTIONAL SOLIDIFICATION PROCESS IN A LIQUID METAL BATH FURNACE

(75) Inventors: Asish Ghosh, Slingerlands; Michael Francis Xavier Gigliotti, Scotia; Shyh-Chin Huang, Latham; Frederic Joseph Klug, Schenectady; Roger John Petterson, Fultonville; Stephen Francis Rutkowski, Duanesburg; Paul Steven Svec, Scotia, all of NY (US); Lawrence Donald Graham, Chagrin Falls; Robert Mark Garlock, Chardon, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/217,883

(22) Filed: Dec. 21, 1998

(51) Int. Cl.[7] ..... B22D 41/01; B22D 27/04

(52) U.S. Cl. ..... 164/338.1; 164/122.1; 164/348; 164/126

(58) Field of Search ..... 164/338.1, 348, 164/126, 128, 122.1, 418, 478, 416

(56) References Cited

U.S. PATENT DOCUMENTS

| | | | | | |
|---|---|---|---|---|---|
| 3,752,221 | A | * | 8/1973 | Copley et al. | 164/338 |
| 3,763,926 | A | * | 10/1973 | Tschinkel et al. | 164/338 |
| 4,108,236 | A | | 8/1978 | Salkeld | |
| 4,175,609 | A | | 11/1979 | El Gammal et al. | |
| 4,736,789 | A | * | 4/1988 | Shinopulos et al. | 164/416 |
| 4,807,691 | A | * | 2/1989 | Schneider et al. | 164/416 |
| 5,642,769 | A | * | 7/1997 | Thone et al. | 164/416 |
| 5,983,973 | A | * | 11/1999 | Cornie | 164/97 |

FOREIGN PATENT DOCUMENTS

EP 631832 A1 4/1995

* cited by examiner

*Primary Examiner*—M. Alexandra Elve
*Assistant Examiner*—Len Tran
(74) *Attorney, Agent, or Firm*—Robert P. Santandrea; Noreen C. Johnson

(57) ABSTRACT

A mold basket, for supporting a mold, for use in a liquid metal bath furnace with an elevator, comprising a flange for suspending the mold basket from the elevator; and a horizontal plate disposed beneath the flange for supporting the mold, wherein the plate is coupled to the flange with a plurality of vertical tie rods.

15 Claims, 6 Drawing Sheets

MOLD AND MOLD BASKET FOR USE IN UNI-DIRECTIONAL SOLIDIFICATION PROCESS IN A LIQUID METAL BATH FURNACE

BACKGROUND OF THE INVENTION

The present invention relates generally to casting of metals, and more specifically, relates to a mold basket and to an improved ceramic mold used in a metal bath furnace for the directed solidification of superalloys.

Certain components, such as for example turbine blades and stator vanes for gas turbine engines, because of their relatively complex shapes and harsh operating environment to which these components are exposed, are typically cast of nickel-based and cobalt-based alloys which are conventionally known as superalloys, which have high strength and typically very high melting temperatures.

The strength of such components is enhanced by forming the turbine vanes (stators) and particularly the turbine blades using directional solidification casting for obtaining substantially single crystal components. Such process is conventionally known.

Various processes and apparatus for directional solidification casting, such as directional solidification casting apparatus and method disclosed in U.S. Pat. Nos. 4,108,236 and 4,175,609, are known in the industry and vary in effectiveness. In these processes, a suitable ceramic mold is specifically configured for the particular component being cast, such as a gas turbine engine blade or vane. The mold is lowered into a heating chamber where it is pre-heated, and subsequently then filled with a desired superalloy in a superheated liquid melt condition. Thereafter, the bottom of the mold is then subjected to preferential cooling to commence the unidirectional solidification process necessary for single crystal formation, which travels upwardly through the mold.

Cooling of the mold may be accomplished in different manners. In one conventional process, a suitable liquid metal coolant, such as molten tin or aluminum, is contained in a bath below the mold, with the mold then being immersed into the cooling bath for effecting a substantially large temperature gradient in the melt for enhancing directional solidification.

In a typical directional solidification casting furnace, solid superalloy known as a "charge", is initially placed inside a melting crucible surrounded by a suitable heater, such as an induction heater, which melts the charge to form the liquid melt with suitable superheat. In this respect, the mold is initially positioned inside a heating chamber within a furnace, which preheats the mold to a suitable elevated temperature. These components are typically disposed within a common pressure vessel or housing which makes up the furnace, which is typically evacuated, or filled with a suitable inert gas.

During the process, the melt is poured from the melting crucible into preheated mold. The mold is then lowered, bottom end first, into the bath for immersion cooling thereof to directionally solidify the melt upwardly inside the mold. Upon completion of melt solidification inside the mold, the mold is removed upwardly from the bath, furnace, and housing. A new charge and mold are placed inside the housing and the process is repeated to cast additional parts.

In lowering the mold into the liquid metal bath, the mold is supported within an elevator chamber which may be moved up and down by a piston or equivalent motive means.

In this respect, the mold, conventionally, rests on a chill plate of a basket-like structure which extends downwardly within the elevator chamber. The chill plate is adapted to effect cooling of the mold by conducting heat from the mold to the liquid metal bath.

One such mold basket is particularly described in EPO Serial No. 0631832A1 filed Feb. 2, 1993. As can be seen from FIGS. 1, 2 and 3 of EPO Serial No. 0631832A1, the mold basket disclosed therein offers no lateral support for the mold. The mold is, therefore, relatively dimensionally unstable, such condition potentially leading to spillage of the alloy or even a fracture of the mold. Further, by virtue of being fixedly secured to the elevator, the mold basket in EPO Serial No. 0631832A1 has no means of dissipating the thermal stresses realized during heating and cooling processes within the furnace and metal bath. This may eventually cause fracture of the mold basket, leading to substantial maintenance work for clean-up and consequent downtime.

The shape of the mold is configured to the shape of the article being cast. In some cases, by virtue of such shape, the mold is not dimensionally stable, especially when only supported from its bottom by the above-described chill plate. As a result, reliability of the casting process is compromised. Additional matter could be added to the mold to increase its weight and, therefore, enhance its stability. However, this impedes heat transfer, hence compromising the solidification process.

SUMMARY OF THE INVENTION

The present invention discloses a mold basket, for supporting a mold, for use in a liquid metal bath furnace with an elevator.

In one of its broad aspects, the present invention provides a mold basket, for supporting a mold, for use in a liquid metal bath furnace with an elevator, comprising a flange for suspending the mold basket from the elevator; and a horizontal plate disposed beneath the flange for supporting the mold, wherein the plate is coupled to the flange with a plurality of vertical tie rods. The flange includes an aperture for receiving the mold, wherein the aperture is defined by an inner wall of the flange and the mold is substantially laterally surrounded about its upper edge by the inner wall so as to be laterally supported thereby.

In another aspect, the present invention provides a mold basket, for supporting a mold, for use in a liquid metal bath furnace with an elevator, comprising a basket flange for suspending the mold basket from the elevator; a plate vertically disposed beneath the flange for supporting the mold; and a plurality of tie rods for coupling the flange to the plate, each of the tie rods having first and second ends, wherein the first end is received in a corresponding rod aperture in the flange and the second end is received in a corresponding rod aperture in the cooling plate. Preferably, the rod apertures are guide slots. Furthermore, the mold basket wherein each of the first and second ends of the tie rods are comprised of first and second rod flanges respectively, wherein the first rod flange engages a top surface of the basket flange and the second rod flange engages a bottom surface of the cooling plate for effecting suspension of the cooling plate from the basket flange.

In yet another aspect, the present invention provides a combination mold and mold basket, the mold basket for supporting the mold during cooling thereof in a liquid metal bath furnace having an elevator means for raising and lowering the mold, the mold basket comprising a flange for suspending the mold basket from the elevator means and a horizontal plate vertically disposed beneath the flange for supporting the mold, the plate being coupled to the flange with a plurality of tie rods, wherein the mold has a nesting device for mating engagement with the plate.

The present invention also provides an apparatus for casting directional solidified metal articles comprising: a furnace with a heating chamber for preheating a mold, a melting crucible surrounded by a suitable heater for heating and melting metal, pouring means to pour the heated metal into the preheated mold, a crucible member disposed beneath the heating chamber and containing a liquid metal bath, an elevator for lowering the mold into the liquid metal bath, and a mold basket for supporting the mold, wherein the mold basket comprises a flange for suspending the mold basket from the elevator, and a cooling plate vertically disposed beneath the flange for supporting the mold, and wherein the cooling plate is coupled to the flange with a plurality of tie rods.

BRIEF DESCRIPTION OF DRAWINGS

The invention will be better understood and objects other than those set forth above will become apparent when consideration is given to the following detailed description of preferred embodiments thereof. Such description makes reference to the annexed drawings wherein.

DESCRIPTION OF THE PREFERRED EMBODIMENT

Figure 1:
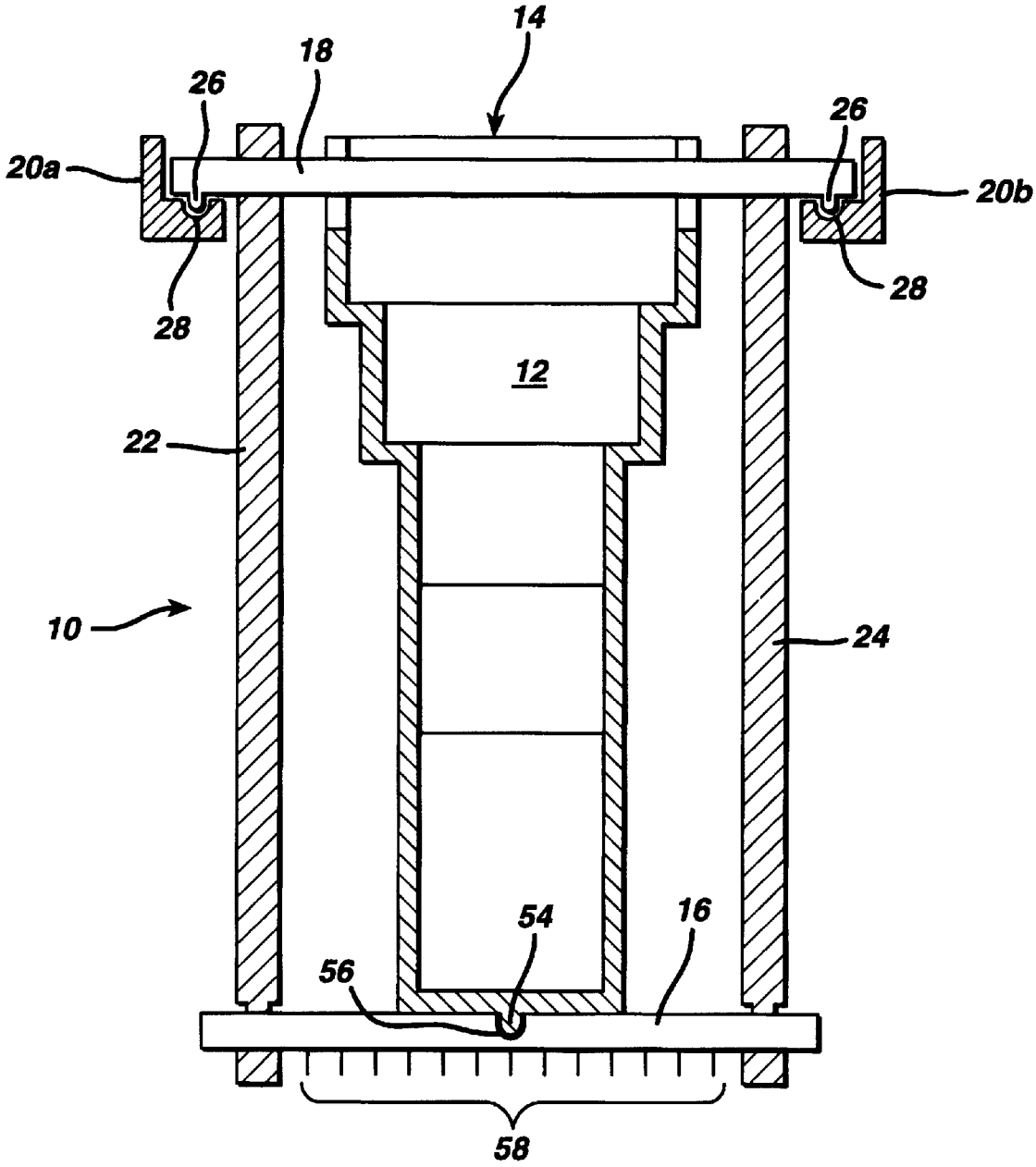
FIG. 1 is a front elevation view of a mold basket of the present invention, showing such mold basket suspended from elevator flanges while supporting a mold.
Figure 2:
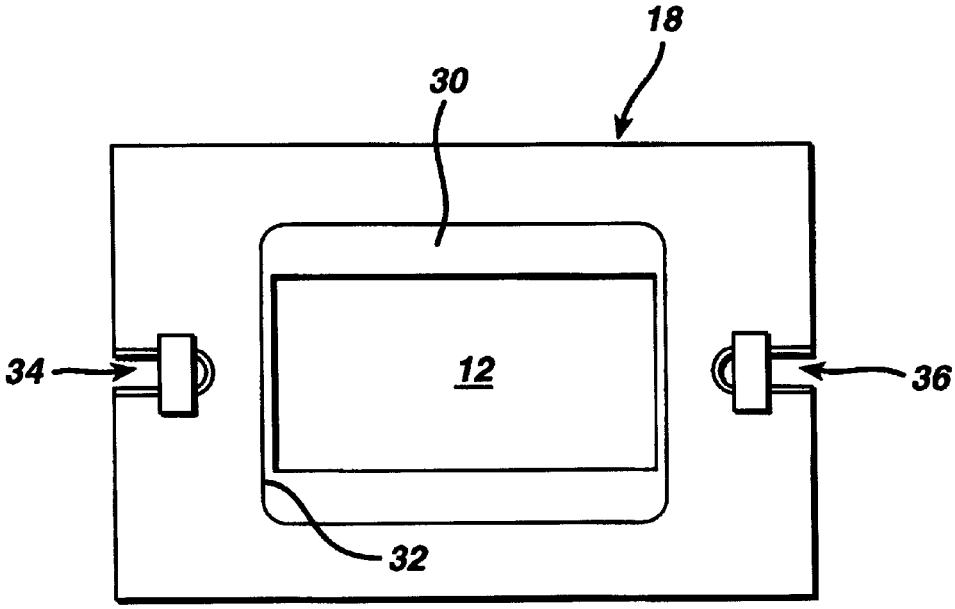
FIG. 2 is a top plan view of the basket flange of the mold basket of the present invention shown in FIG. 1.

Referring to FIGS. 1 and 2, a mold basket 10 is provided for supporting a mold 12 for use in a liquid metal bath furnace with an elevator which may be moved up and down by a piston or equivalent motive means to effect immersion and consequent cooling of the mold 12 in the liquid metal bath. Preferably, the furnace is a directional solidification furnace for the casting of superalloy metals with a heating chamber for preheating the mold 12, a melting crucible surrounded by at suitable heater for heating and melting the metal, a pouring means to pour the heated metal into the preheated mold 12, a crucible member disposed beneath the heating chamber and containing a liquid metal bath, and an elevator means for lowering the mold 12 into the liquid metal bath. In this respect, the mold 12 is adapted to receive a pour of molten superalloy through aperture 14 for subsequent cooling in the liquid metal bath.

The mold basket is provided with a horizontal plate 16 for supporting the bottom of mold 12 which may further be a highly thermally conductive plate. Such plate 16, in addition to supporting the mold 12, may assist in further ensuring cooling of mold 12 at the vertically lower most point in the mold 12 which therefore assists in the vertically upward directional solidification process.

An elevator 21 is provided to effect upward and downward movement of the mold basket 10. In this respect, the mold basket further includes a basket flange 18, vertically disposed relative to the plate 16, for suspending the mold basket 10 from the elevator. The basket flange 18 is adapted for mating engagement with corresponding flanges 20*a*, 20*b* disposed in laterally opposed relationship with each other in the elevator. Elevator flanges 20*a*, 20*b* cooperate with the mold basket flange 18 to facilitate suspension of the mold basket 10 from the elevator. To effect support of the plate 16 and mold 12, plate 16 is connected to basket flange 18 with tie rods (two are shown) 22, 24. It is understood that the number of tie rods is not limited to two, and could include any plurality of tie rods so as to cause effective and stable connection between basket flange 18 and cooling plate 16.

Preferably, the mold basket flange 18 includes a nesting device, such as a spigot 26 adapted for insertion into a corresponding depression 28 in the elevator flange 20, for enhancing the stability of the mold basket 10 as it is suspended from the elevator flange 20. In this respect, engagement of the depression 28 by the spigot 26 is relatively loose to compensate for thermal expansion of materials, including vertical thermal expansion, comprising the mold basket flange 18 and elevator flange 20. It is understood that means for suspending the mold basket 10 from the elevator is not limited to that illustrated in the Figures or that which was above-described, and could include various clamping devices adapted for securing the mold basket to the elevator chamber.

The mold basket flange 18 is further provided with a centrally located aperture 30 adapted for insertion of mold 12. Importantly, the aperture 30 is defined by flange inner wall 32 which is radially disposed in spaced apart relation to mold 12 when mold 12 is supported on plate 16.

Figure 3:
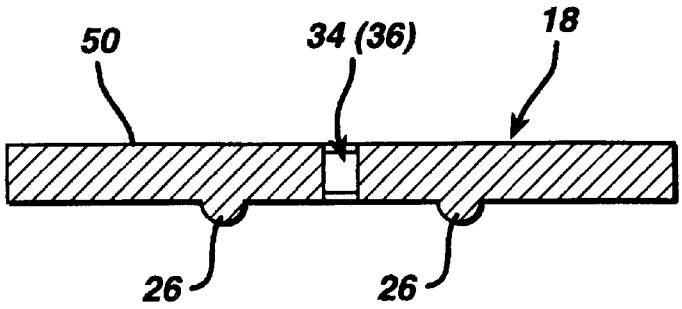
FIG. 3 is a side elevation view of one side of the basket flange of FIG. 2.
Figure 4:
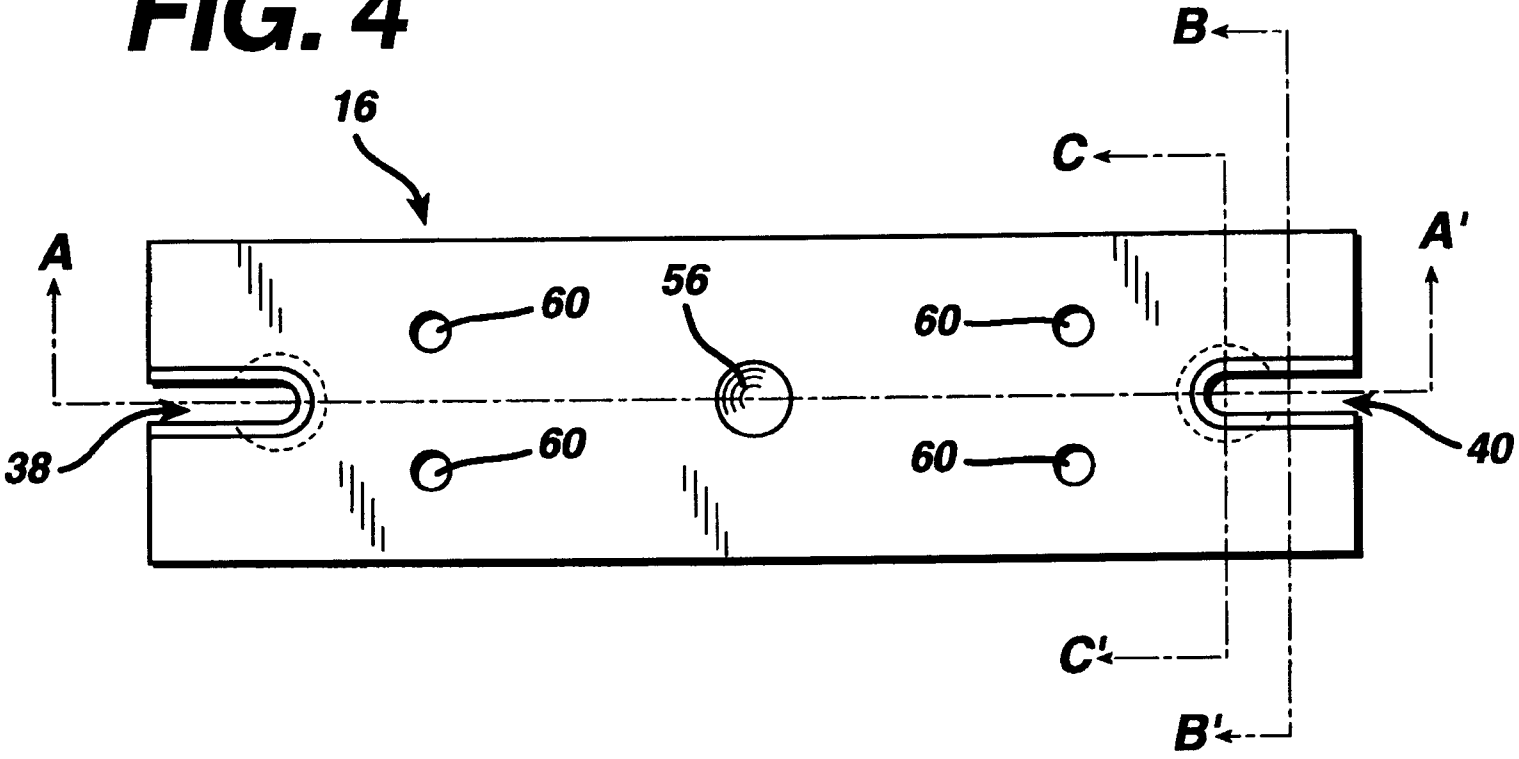
FIG. 4 is a top plan view of the cooling plate of the mold basket of the present invention.

Referring to FIGS. 2, 3 and 4, to effect connection between the mold basket flange 18 and plate 16 with tie rods 22,24, the mold basket flange 18 and plate 16 are provided with corresponding rod apertures 34,36 and 38,40 respectively for receiving each of tie rods 22,24. One-rod aperture on each of the mold basket flange 18 and plate 16 is dedicated to receiving one of the tie rods 18. In this respect, and referring to FIGS. 1,2 and 4, apertures 34 and 38 are dedicated to receiving rod 22 while apertures 36 and 40 are dedicated to receiving tie rod 24.

Figure 5:
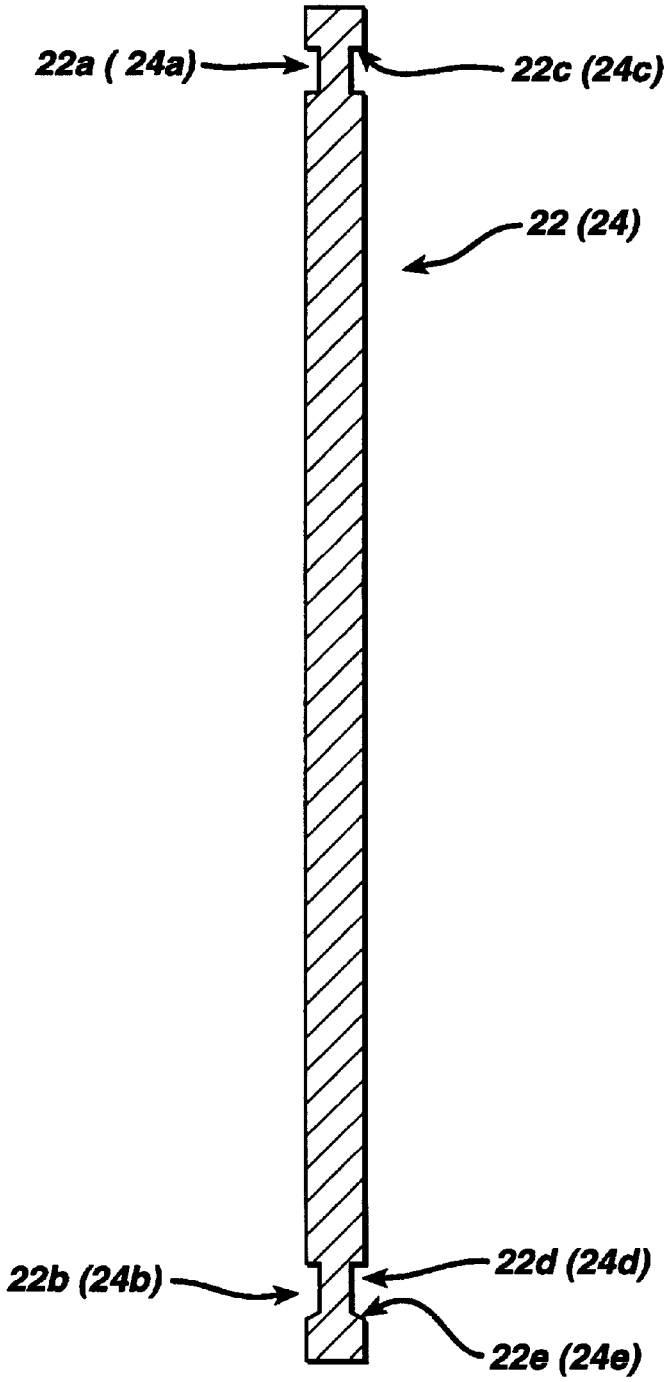
FIG. 5 is a front elevation view of a tie rod of the mold basket of the present invention.

Referring to FIG. 5, in the preferred embodiment, tie rods 22,24 terminate at either end in rod flanges 42,44 and 46,48 respectively. Each set of rod flanges 42,44 and 46,48 are adapted to suspend plate 16 from mold basket flange 18. To receive such tie rods, apertures 34,36 and 38,40 preferably comprise of guide slots which extend inwardly from the perimeter of the associated mold basket flange 18 and plate 16.

Guide slots 34,38 are further adapted to simultaneously receive sliding insertion of rod 22 while permitting engagement of flange 42 with the upper surface 50 of the mold basket flange 18 and engagement of flange 44 with the lower surface 52 of plate 16. Similarly, guide slots 36,40 are adapted to simultaneously receive sliding insertion of rod 24 while permitting engagement of flange 46 with the upper surface 50 of the mold basket flange 18 and engagement of flange 48 with the lower surface 52 of plate 16. When engaged in this manner, rods 22,24 are suspended from the mold basket flange 18 by flanges 42 and 46 respectively, and effect support of plate 16 by suspending same with their respective flanges 44 and 48. Advantageously, the rods 22, 24 can be readily engaged to and disengaged from basket flange 18 and plate 16, thereby effecting faster assembly and disassembly of mold basket 10.

To prevent tie rods 22,24 from sliding out of engagement with slots 34,38 and 36,40 respectively, guide slots 34 and 36 are oriented such that they are laterally opposed to elevator flanges 20*a* and 20*b* respectively when mold basket 10 is suspended from flanges 20*a* and 20*b*. For the same purpose, mold basket is further adapted such that, when mold basket 10 is suspended from elevator flanges 20*a* and 20*b*, each of elevator flanges 20*a* and 20*b* is vertically disposed beneath guide slots 34 and 36 respectively. Hence, in this respect, flanges 20*a* and 20*b* act as a detent for preventing tie rods 22,24 from sliding out of engagement with slots 34,38 and 36,40 respectively and destabilizing the mold basket 10.

Preferably, the longitudinal distance between rod flanges 42 and 44 of the rod 22 and between rod flanges 46 and 48 of the rod 24 is such that, when effecting suspension of cooling plate 16 from mold basket flange 18 while mold 12 is supported on plate 16, the top portion of the mold 12 is disposed in laterally opposed relationship with flange inner wall 32. In this respect, inner wall 32 acts as a detent to limit lateral movement of mold 12 and, therefore provides some lateral stability to mold 12.

Advantageously, mold 12 does not fixedly positively engage aperture 30 and inner wall 32, as showing FIG. 2, to allow slidable vertical movement of mold 12 relative to plate 16 and the rods 22, 24 which are typically of different material than mold 12 and thus have a different coefficient of thermal expansion. The contact between inner wall 32 and mold 12 is sufficient, however, to provide lateral support to mold 12, while at the same time permitting slidable vertical expansion of the mold 12 relative to the flange.

Mold stability may be further enhanced by providing mold 12 with nesting means to stabilize the mold 12 when it is supported on plate 16. By way of example, mold 12 may be provided with spigot 54 in the form of an upwardly extending protuberance extending upwardly from the bottom surface of the mold 12 and adapted to engage depression 56 on plate 16 when mold 12 is supported on plate 16. Alternatively, a spigot may be provided on the upper surface of plate 16 and adapted for engagement with a corresponding depression in mold 12.

To enhance directional solidification, plate 16 may include one or more fins 58 extending downwardly from the bottom surface thereof. Such configuration enhances heat transfer between the plate 16 and the liquid metal bath, thereby assisting in the vertically upward (as opposed to radial) directional solidification, which is desired in liquid metal bath furnaces. The plate 16 may also include one or more apertures 60, allowing liquid metal bath to permeate plate 16 thereby assisting cooling of plate 16 and thus assisting in the unidirectional upward cooling process.

Each of the components of the mold basket 10 are comprised of highly refractive materials, resistant to corrosion in liquid aluminum at 1300° C. As examples, such materials include refractory fibers of any materials such as alumina, nextel, silicon carbide, graphite/silicon carbide composite, silicon carbide/silicon carbide composite, or carbon/carbon composite. Typically, the plate 16 is of a carbon fiber felt, but other refractive materials may be used.

Advantageously, the invention may be adapted to conduct batch processing of molds. In that respect, the mold basket 12 may be adapted to support a gang mold. To facilitate this, aperture 30 may be operatively adapted in correspondence with the dimensions of such gang mold to receive same.

Figure 6:
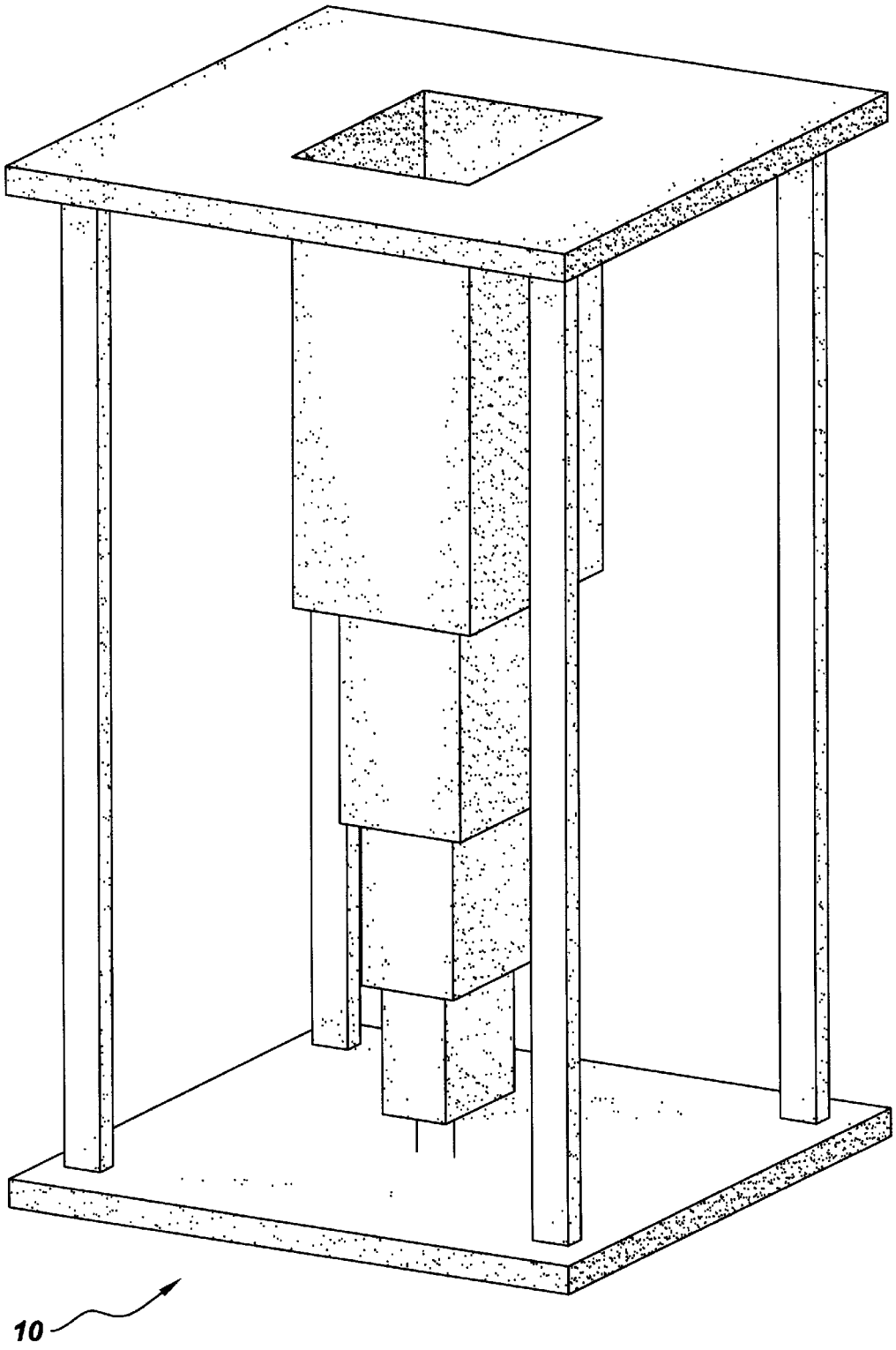
FIG. 6 is a front perspective view of the ceramic mold of the present invention.
Figure 7:
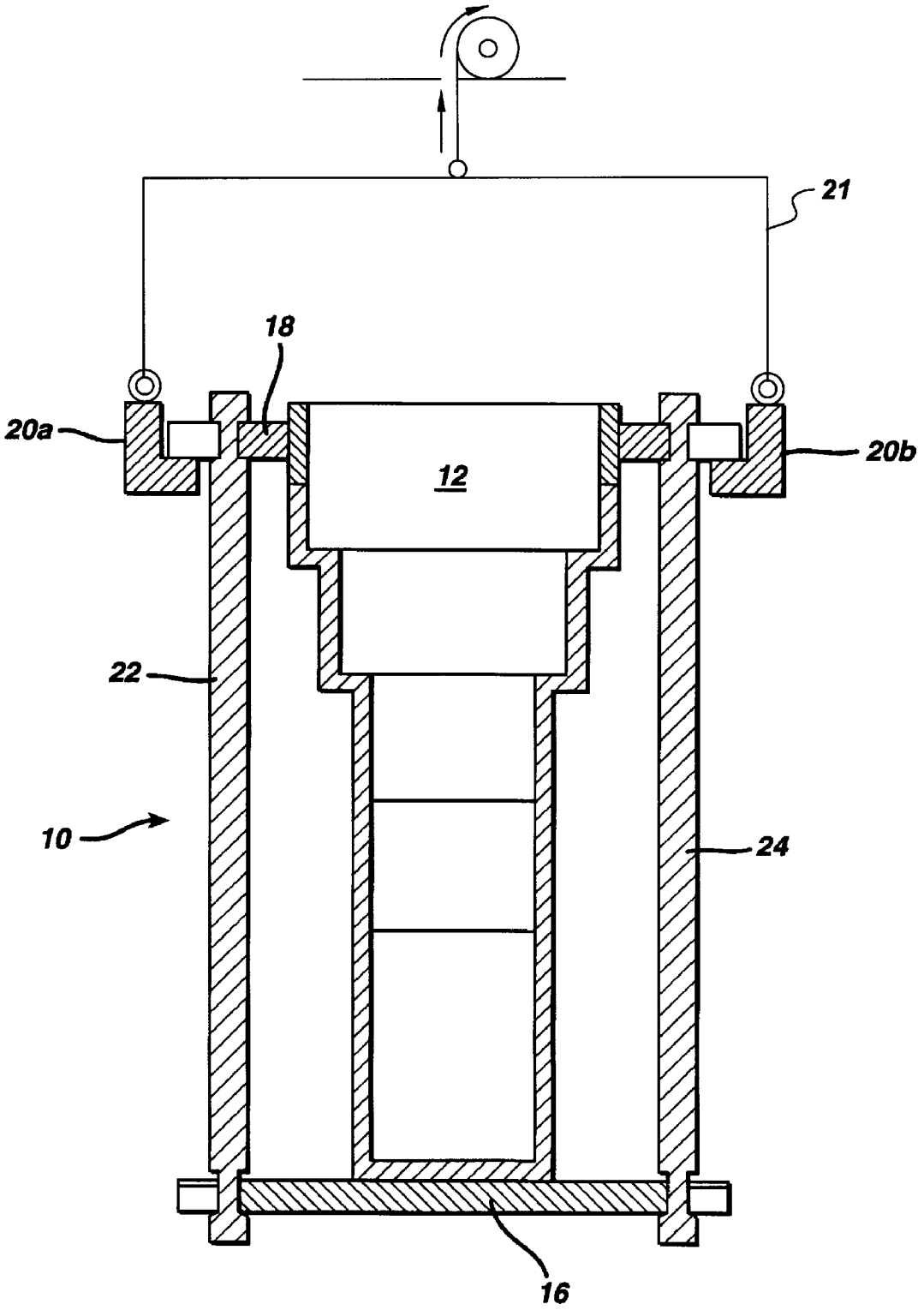
FIG. 7 is a side view of the mold basket and elevator of the present invention.

Referring to FIG. 6, a ceramic mold 10 is provided for use in the casting of metal articles. In one embodiment, the furnace is a directional solidification furnace for the casting of superalloy metals with a heating chamber for preheating the mold 12, a melting crucible surrounded by a suitable heater for heating and melting the metal, a pouring means to pour the heated metal into the preheated mold 12, a crucible member disposed beneath the heating chamber and containing a liquid metal bath, and an elevator for lowering the mold 12 into the liquid metal bath. In this respect, the mold 12 is adapted to receive a pour of molten superalloy through aperture 14 for subsequent cooling in the liquid metal bath.

EXAMPLES

Two sets of tests were conducted with molds. One example (I) was carried out with the mold basket with the tie rods using liquid metal cooling. The second example (II) was conducted with a mold without a mold basket, i.e. having no support at the bottom. Table 1 shows the results.

TABLE 1

| Example | # of Tests | # Passed | Type of Cooling | Mold basket | Mold Design (tie rods) |
|---|---|---|---|---|---|
| I | 4* | 4 | liquid metal | yes | Yes |
| II | 1 | 0 | liquid metal | no | no |

One of the tests was carried out without any molten metal in the mold

Example I

Three molds with tie rods were placed in the mold basket, suspended from a vertically mobile fixture, and were heated to 1550° C. in three hours. Metal was poured through the pour cup at this temperature, and the molds along with the mold basket were immersed in molten aluminum for solidification. After complete immersion, the molds along with the mold basket were taken out, and cooled to room temperature. No metal leaked from the molds. Mold basket was reusable after every test. An additional test went through the same process without pouring any molten metal in the mold. The same basket was used in all four tests.

Example II

One test was carried out with a mold, without a mold basket, (i.e. no support at the bottom), suspended from a vertically mobile fixture. Molten metal was poured; the mold failed and leaked metal in the aluminum bath. The leak happened at the bottom of the mold where there is maximum hydrostatic pressure. Test schedule was similar to the test carried out in example I. Although the mold did not have tie rods, the reason for metal leakage was attributed to the lack of a mold basket.

It will be understood, of course, that modifications can be made in the embodiments of the invention described herein without departing from the scope and purview of the invention as defined by the appended claims.

We claim:

1. A unidirectional mold basket for supporting at least one unidirectional mold for insertion in a liquid metal bath furnace, said mold basket comprising:

a flange for suspending said mold basket, said flange having at least one aperture for receiving said at least one unidirectional mold, wherein said aperture is defined by an inner wall of said flange, said inner wall being radially disposed in spaced apart relation to said unidirectional mold and acting as a detent to limit lateral movement of said unidirectional mold, and wherein said unidirectional mold is slidably removable vertically relative to said inner wall;

a horizontal plate disposed beneath said flange for supporting said unidirectional mold, said horizontal plate being thermally conductive; and a plurality of tie rods, each of said tie rods having a first rod end received in a rod aperture in said horizontal plate and a second rod end received in a corresponding rod aperture in said flange, said second rod end being distal from said first rod end, wherein said plurality of tie rods extend vertically between said horizontal plate and said flange, thereby connecting said horizontal plate to said flange.

2. The unidirectional mold basket of claim 1 wherein said aperture provides lateral support for said mold and allows slidable vertical movement of said mold relative to said mold basket.

3. A unidirectional mold basket for supporting a unidirectional mold for use in a liquid metal bath furnace, said mold basket comprising:

a basket flange for suspending said mold basket, said basket flange having at least one aperture for receiving said at least one unidirectional mold, wherein said aperture is defined by an inner wall of said basket flange, said inner wall inner wall being radially disposed in spaced apart relation to said unidirectional mold and acting as a detent to limit lateral movement of said unidirectional mold, and wherein said unidirectional mold is slidably removable vertically relative to said inner wall;

a horizontal plate disposed beneath said flange for supporting said unidirectional mold, said horizontal plate being thermally conductive; and a plurality of tie rods for connecting said basket flange to said horizontal plate, each of said tie rods having a first end and a second end distal from said first end, wherein said first end is received in a corresponding rod aperture in said basket flange and said second end is received in a corresponding rod aperture in said horizontal plate.

4. The unidirectional mold basket of claim 3 wherein said rod apertures are guide slots.

5. The unidirectional mold basket of claim 4 wherein each of said first and second ends of said tie rods are comprised of first and second rod flanges respectively, wherein said first rod flange engages a top surface of said basket flange and said second rod flange engages a bottom surface of said plate for effecting suspension of said plate from said basket flange.

6. The unidirectional mold basket of claim 1, wherein said flange, said tie rods, and said horizontal plate are formed from refractory materials that are resistant to corrosion by liquid aluminum.

7. The unidirectional mold basket of claim 1, wherein said flange, said tie rods, and said horizontal plate are formed from refractory materials selected from the group consisting of alumina, nextel, silicon carbide, graphite/silicon carbide composite, silicon carbide/silicon carbide composite, and carbon/carbon composite.

8. The unidirectional mold basket of claim 3, wherein said flange, said tie rods, and said horizontal plate are formed from refractory materials that are resistant to corrosion by liquid aluminum.

9. The unidirectional mold basket of claim 3, wherein said flange, said tie rods, and said horizontal plate are formed from refractory materials selected from the group consisting of alumina, nextel, silicon carbide, graphite/silicon carbide composite, silicon carbide/silicon carbide composite, and carbon/carbon composite.

10. A unidirectional mold basket for supporting at least one unidirectional mold for use in a liquid metal bath furnace with an elevator, said mold basket comprising:

a flange for suspending said mold basket from said elevator, said flange having at least one aperture for receiving said at least one unidirectional mold, wherein said aperture is defined by an inner wall of said flange, said inner wall being radially disposed in spaced apart relation to said unidirectional mold and acting as a detent to limit lateral movement of said unidirectional mold, and wherein said unidirectional mold is slidably removable vertically relative to said inner wall;

a horizontal plate disposed beneath said flange for supporting said unidirectional mold, said horizontal plate being thermally conductive; and a plurality of tie rods, each of said tie rods having a first rod end received in a rod aperture in said horizontal plate and a second rod end received in a corresponding rod aperture in said flange, said second rod end being distal from said first rod end, wherein said plurality of tie rods extend vertically between said horizontal plate and said flange, thereby connecting said horizontal plate to said flange.

11. The unidirectional mold basket of claim 10, wherein said aperture provides lateral support for said mold and allows slidable vertical movement of said mold relative to said mold basket.

12. The unidirectional mold basket of claim 10, wherein said rod apertures are guide slots.

13. The unidirectional mold basket of claim 12, wherein each of said first rod end and second rod end of each of said plurality of tie rods are comprised of a first rod flange and second rod flange, respectively, wherein said first rod flange engages a top surface of said flange and said second rod flange engages a bottom surface of said horizontal plate for effecting suspension of said horizontal plate from said flange.

14. The unidirectional mold basket of claim 10, wherein said flange, said tie rods, and said horizontal plate are formed from refractory materials that are resistant to corrosion by liquid aluminum.

15. The unidirectional mold basket of claim 10, wherein said flange, said tie rods, and said horizontal plate are formed from refractory materials selected from the group consisting of alumina, nextel, silicon carbide, graphite/silicon carbide composite, silicon carbide/silicon carbide composite, and carbon/carbon composite.

* * * * *